US005826891A

United States Patent [19]

Albrecht

[11] Patent Number: 5,826,891

[45] Date of Patent: Oct. 27, 1998

[54] SNOWBOARD BINDING

[75] Inventor: Stephan Albrecht, Bad Wiessee, Germany

[73] Assignee: F2 International Ges.m.b.H., Krems, Austria

[21] Appl. No.: 502,281

[22] Filed: Jul. 13, 1995

[30] Foreign Application Priority Data

Jul. 13, 1994 [DE] Germany ..... 44 24 737.0

[51] Int. Cl.[6] ..... A63C 9/18

[52] U.S. Cl. ..... 280/14.2; 280/626; 280/623

[58] Field of Search ..... 280/607, 617, 280/618, 620, 623, 626, 630, 634, 14.2

[56] References Cited

U.S. PATENT DOCUMENTS

| | | | |
|---|---|---|---|
| 3,838,866 | 10/1974 | D'Alessio et al. | 280/607 |
| 4,128,257 | 12/1978 | Zoor | 280/618 |
| 4,384,733 | 5/1983 | Krob et al. | 280/634 |
| 4,629,209 | 12/1986 | Lorenz et al. | 280/634 |
| 5,544,909 | 8/1996 | Laughlin et al. | 280/14.2 |

FOREIGN PATENT DOCUMENTS

| | | | |
|---|---|---|---|
| 2218478 | 5/1973 | Germany | 280/626 |
| 4106401 | 2/1991 | Germany . | |
| 9215995 | 11/1992 | Germany . | |
| 9403101.0 | 2/1994 | Germany . | |
| 457231 | 7/1968 | Switzerland | 280/626 |

*Primary Examiner*—Robert J. Oberleitner
*Assistant Examiner*—Min Yu
*Attorney, Agent, or Firm*—Senniger, Powers, Leavitt & Roedel

[57] ABSTRACT

A snowboard binding with step-in function holds a boot by means of front and heel brackets. The heel bracket is preferably coupled to a driving element that moves the heel bracket in the direction toward the other bracket and simultaneously downward, namely in the direction toward the snowboard surface, during the movement from the open position to the closed position. A spring piston locks the driving element directly or indirectly in the closed position. This locking effect is realized in such a way that the closing force of the binding does not depend on the force of the spring of the spring piston.

12 Claims, 6 Drawing Sheets

1
2
3
4
5
6
7
8
9
10
11
12
13
14
15
16
17
18
19
20
21
22
23
24
26
33

1
2
3
4
5
6
7
8
9
10
11
12
13
14
15
16
17
18
19
20
21
22
27
28
α

SNOWBOARD BINDING

BACKGROUND OF THE INVENTION

The invention pertains to a snowboard binding for binding a boot to a snowboard.

One binding of this type is known from DE 9,215,995.8-U1. This document discloses a so-called "step-in" binding in which the rider or snowboarder does not have to manually activate any locking elements when stepping into the binding. The boot is held by means of two conventional brackets, i.e., a front bracket and a heel bracket. The heel bracket is fastened onto a sliding element that can be displaced along a guidance, namely by means of a toggle lever. The toggle lever elements are coupled to the sliding element as well as the guidance. If the sole of the snowboarding boot presses against the toggle lever elements, the toggle lever elements are pivoted into a position in which the dead center position is exceeded and the sliding element is displaced into the closed position in which the heel bracket simultaneously pulls the sole of the boot in the direction toward the snowboard surface and in the direction toward the front bracket such that the boot is fixed in its position.

DE 9,403,101.0-U1 also discloses a step-in snowboard binding with a front bracket and a heel bracket, with the heel bracket being displaced along a transversely extending guidance. This guidance is arranged in such a way that the heel bracket is simultaneously displaced in the direction toward the snowboard surface and in the direction toward the front bracket when a tread element that is connected to the guidance and the heel bracket is pressed down with the sole of the boot. In the closed position, a locking tappet catches behind a projection and consequently fixes the binding.

DE 4,106,401 A1 discloses a step-in snowboard binding with a front bracket and a heel bracket in which the heel bracket is coupled to a tread element that is realized in the form of a pivoted lever. The tread element is fastened in pivoting fashion onto the binding components that are rigidly connected to the snowboard. The tread element contains one element of the locking mechanism, i.e., an element that is realized in the form of a locking tappet. The other element of the locking mechanism is realized in the form of a catch element that is fastened onto a holding rod and overlaps the catch tappet when the tread element is entirely pressed down such that the binding is locked. The skier must bend down and manually activate this locking mechanism in order to open the binding. The locking of the tread element cannot be insured if snow or ice is situated underneath the sole of the boot because this snow or ice would initially contact the binding before the tread element can be entirely pressed down. Consequently, this binding is only able to fulfill limited functions.

Many snowboard riders have expressed for quite some time their desire for a so-called "step-in" snowboard binding, i.e., a binding that makes it possible for the snowboard riders to simply step into the binding similar to conventional ski bindings without having to bend down so as to activate parts of the binding, e.g., locking brackets. However, self-releasing bindings for snowboards which allow a complete separation of the boot from the snowboard in instances in which excessively high forces act upon the foot of the skier are associated with certain difficulties because the safety problems for the snowboard riders or bystanders have not been solved in a satisfactory fashion despite numerous suggestions. In addition, one needs to take into consideration the serious spatial problems that exist with snowboard bindings. A snowboarder essentially stands on the snowboard transverse to the moving direction, i.e., the angle formed by the longitudinal axis of the boot and the longitudinal axis of the snowboard is between 45° and 90°. Some snowboarders even align the rear foot opposite to the moving direction, i.e., at an angle that exceeds 90°. Since snowboards and, in particular, so-called alpine boards for skiers become increasingly narrower, the toe of the boot and the heel of the boot nowadays already protrude over the contour of the snowboard. However, a snowboard binding should, in principle, not protrude over the toe of the boot or the heel of the boot because this would cause the protruding parts of the binding to contact the snow when the snowboard is tilted. This is the reason why conventional ski bindings with the "step-in" function are not suitable for snowboards.

Consequently, the invention is based on the objective of improving a snowboard binding of the initially mentioned type in such a way that the ease of operating the binding is improved, and also that the binding is still able to fulfill the requirements for low weight, the appropriate functional safety and the lowest possible cost.

SUMMARY OF THE INVENTION

The basic idea of the invention is that the driving element is continuously connected to one end of a spring piston in pivoting fashion, and that the spring piston is provided with a limit stop that limits its movement such that the ease of stepping in and out of the binding is improved significantly because the snowboarders no longer must bend down to the snowboard, such that the additional advantages described below are attained.

Due to the continuous connection between the spring piston and the driving element, the binding is held in a defined position, namely in the open as well as the closed position, and said binding is less susceptible to icing because ice or snow residues within the region of the spring piston are stripped off due to a compulsory movement that takes place with the opening or closing of the binding.

According to one variation of the invention, the connection between the spring piston and the driving element is realized by means of one additional closing lever that is fastened onto both aforementioned components in pivoting fashion. Due to this measure, one attains a toggle lever effect for closing the binding as well as one or two additional positions in which the dead center position is exceeded. According to one additional development of the invention, the driving element, the closing lever and the spring piston assume a position in which the dead center position is exceeded, namely a position in which the angle between the longitudinal axis of the spring piston and the center axis of the closing lever is less than 90°. In the position in which the dead center position is exceeded, the aforementioned components are arranged in such a way that an opening movement that originates from the driving element acts upon the spring piston via the closing lever, namely in a direction in which the movement of the spring piston is blocked by the limit stop. Consequently, the closed position of the binding does not depend on the spring force. This represents a significant advantage because the binding is unable to open in an uncontrolled fashion. This measure also makes is possible to dimension the spring so that it is relatively weak, such that the forces required for closing the binding are reduced. However, if the closing movement is limited in such a way that the aforementioned position in which the dead center position is exceeded is not reached, one attains a safety-release binding that opens automatically once the forces between the boot and the binding exceed a value that is predetermined by the spring stiffness.

One additional advantage can be seen in the fact that one and the same limit stop acts in the opened and the closed positions such that the spring piston is only released from the limit stop for a very brief duration during the opening and closing movements. Consequently, the critical points of the binding are practically unable to ice up and no snow is able to accumulate at these locations.

Briefly, therefore, the invention is directed to a snowboard binding for releasably binding a boot to a snowboard. The binding has a front bracket for partially overlapping a sole of the boot at its toe and a heel bracket for partially overlapping the sole of the boot at its heel, one of the brackets being fastened on two sides to a movable driving element that can be moved relative to a binding component affixed to the snowboard. There is a pivotable closing lever pivotably connecting the driving element to one end of a spring piston and a limit stop for limiting movement of the spring piston in the direction of its spring force when the binding is in its open position as well as in its closed position. In the binding's closed position, an angle between the longitudinal axis of the spring piston and a central axis through coupling points of the closing lever is less than 90°. In the binding's open position, this angle is greater than 90°. The driving element and the spring piston are arranged such that, when the binding is in its closed position, an opening movement originating from the driving element acts upon the spring piston via the closing lever in a direction of movement that is limited by said limit stop.

The invention is also directed to a snowboard binding for releasably binding a boot to a snowboard. The binding has a front bracket for partially overlapping a sole of the boot at its toe and a heel bracket for partially overlapping the sole of the boot at its heel, one of brackets being fastened on two sides to a movable driving element that can be moved relative to a binding component affixed to the snowboard. The driving element is pivotably connected to one end of a spring piston directly via a pivotable closing lever or indirectly via a drag bearing. There is a limit stop for limiting movement of the spring piston.

Other objects and features of the invention will be in part apparent and in part pointed out hereinafter.

BRIEF DESCRIPTION OF THE DRAWINGS

The invention is described in detail with references to the embodiment examples illustrated in the figures. The figures show.

Identical reference numerals in the respective figures identify identical components or components that function identically.

DETAILED DESCRIPTION OF THE INVENTION

Figure 1:
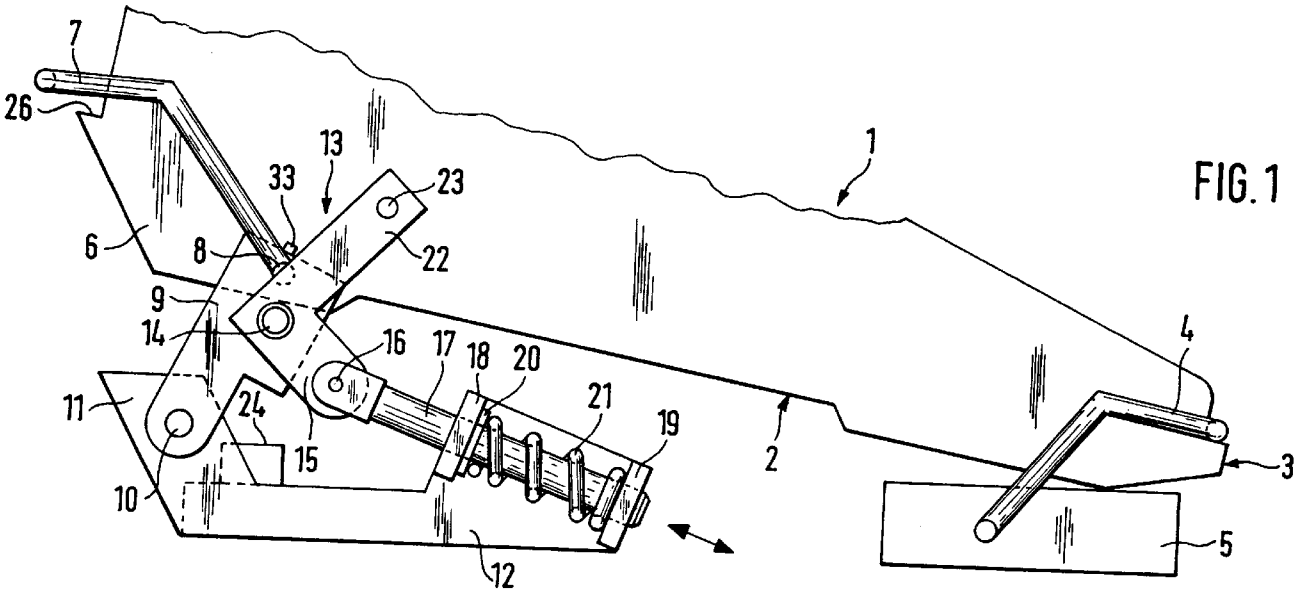
FIG. 1: a side view of a snowboard binding according to a first embodiment example of the invention in its open position.

FIGS. 1 shows a side view of a snowboard binding that overlaps the sole 2 of the boot 1 with a front bracket 4 at the toe 3 and a heel bracket 7 at the heel 6. Consequently, the snowboard binding fixes the boot to a snowboard (not shown). The front bracket 4 is coupled in pivoting fashion to a fastening block 5 that, in turn, is rigidly connected to the snowboard preferably by means of a screw connection. The front bracket 4 can also be rigidly arranged on the fastening block 5 because it is not required that the front bracket pivot. A rigid front bracket even provides the advantage that the heel can be positioned into the initial position in a more accurate fashion.

The heel bracket 7 is coupled to a pivoting lever 9 via a first drag bearing 8. The other end of the pivoted lever is fastened in pivoting fashion to a support 11 via one additional drag bearing 10. The support is integrally connected to a base plate 12 and protrudes from the snowboard surface. The base plate 12 is also rigidly connected to the snowboard surface, preferably by means of a screw connection.

A safety and opening lever 13 is arranged on the pivoting lever 9 via a drag bearing bolt 14, with said drag bearing bolt 14 being arranged offset relative to the two drag bearings 8 and 10, namely in the direction toward the toe 3 of the boot with reference to a connecting line between the two drag bearings 8 and 10. The drag bearing bolt is situated between the drag bearings 8 and 10, but closer to the drag bearing 8. It is also possible to arrange the drag bearing bolt closer to the drag bearing 10 such that the effective lever and consequently the travel of the heel bracket are shortened. The safety and opening lever 13 comprises a first arm 15 that is connected to a spring piston 17 via one additional drag bearing 16. The spring piston 17 is arranged in two sliding bearings 18 and 19 such that it can be displaced in the longitudinal direction and carries a limit stop disk 20, against which one end of a spring 21 is supported. The other end of the spring 21 is supported against the sliding bearing 19. In the open position shown, the limit stop disk 20 is in contact with the sliding bearing 18 and consequently defines a limited open position for the entire binding.

The safety and opening lever 13 comprises a second opening arm that extends perpendicular to the arm 15 and is provided with an opening 23 at its free end into which a cord can be threaded.

In FIG. 1, the boot 1 is illustrated in its step-in position in which the toe 3 is engaged with the front bracket 4 and the heel part 6 of the sole 2 rests on the drag bearing bolt 14. However, the heel bracket 7 is not yet engaged with a shoulder 26 of the sole 2. If the heel is pressed down from this position in the direction toward the snowboard surface, the pivoting lever 9 pivots about the axis of the drag bearing 10 such that both drag bearings 8 and 14 are pressed forward in the direction toward the toe 3 of the boot, namely along an arc, and both drag bearings are simultaneously pressed down in the direction toward the snowboard surface. Due to this displacement, the arm 15 of the safety and opening lever 13 is also displaced and presses the spring piston 17 that can be displaced in linear fashion forward against the force of the spring 21. Since the spring piston 17 can only be displaced in linear fashion, the drag bearing 16 is only able to travel along a straight line such that the safety lever 13 is pivoted in the counterclockwise direction (refer to FIG. 1) during this movement. A first dead center position is reached as soon as the three drag bearings 10, 14 and 16 lie on a straight line. The pivoting lever 9 and the safety lever 13 or its arm 15 are arranged in such a way that the drag bearings 10, 14 and 16 form a triangle, with the drag bearing 14 being situated above the two bearings 10 and 16 in the open position such that a toggle lever effect that acts upon the spring piston 17 is attained via the corresponding lever arms when pressing down. Originating from the open position, the angle between the pivoting lever 9 and the arm 15 increases until the first dead center position in which the three bearings 10, 14 and 16 lie on a straight line is reached. In this case, the arm 15 is pivoted opposite to the pivoting direction of the pivoting lever 9. The bearing 14 travels underneath the connecting line between the bearings 10 and 16 when the first dead center position is exceeded.

Figure 2:
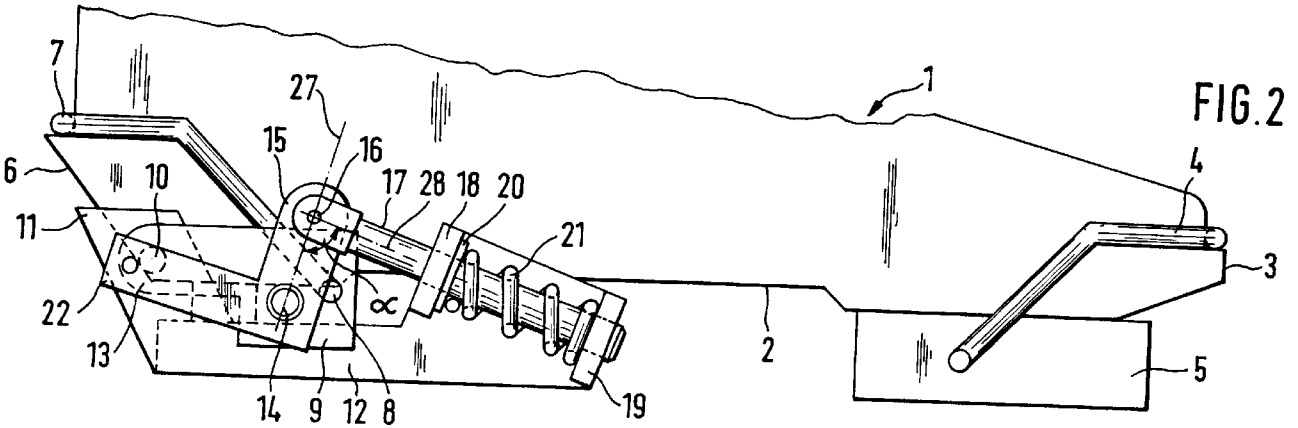
FIG. 2: a side view of the binding according to FIG. 1, but in the closed position.

Upon further pressing of the drag bearing bolt 14, the spring piston 17 slides back in the direction toward the heel 6 due to the spring 21 and promotes the rotational or pivoting movement of the pivoting lever 9 and the safety and opening lever 13. This movement continues until the limit stop disk 20 comes in contact with the sliding bearing 18. The binding now has assumed the closed position illustrated in FIG. 2. In this case, a second position is passed in which the dead center position has been exceeded, namely a position in which the arm 15 or, in more precise terms, a connecting line 27 between the centers of the two drag bearings 14 and 16 has exceeded a right angle with the longitudinal axis 28 of the spring piston 17. In this case, the two lines 27 and 28 form an angle $\alpha$ that is less than 90°, as shown in FIG. 2. This second position in which the dead center position is exceeded is of essential importance for making the closing force of the binding independent of the stiffness of the spring 21. An upwardly directed tensile force on the heel bracket 7 which tends to pivot the pivoting lever 9 upward (i.e., counterclockwise with reference to the side view according to FIG. 2) would also press the drag bearing bolt 14 and consequently the locking arm 15 upward. Since the angle $\alpha$ is less than 90°, a force that pulls the spring piston 17 back toward the heel would be created in this instance. However, this force is unable to trigger any movement since any such movements are blocked by the limit stop 20.

It should also be noted that the drag bearing 8 that fastens the heel bracket 7 on the pivoting lever 9 is situated underneath the drag bearing 10 in the closed position, i.e., in a plane that lies parallel to the snowboard surface and is situated closer to the snowboard surface than the plane in which the drag bearing 10 lies. Regarding the clamping forces between the two brackets 4 and 7 which are directed parallel to the snowboard surface, a position in which the dead center position is exceeded is also reached with respect to the drag bearings 8 and 10 such that the pivoting lever 9 is pressed into its closed position (FIG. 2).

During the pivoting movement of the pivoting lever 9, the heel bracket 7 is simultaneously moved forward in the direction toward the toe of the boot and downward in the direction toward the snowboard such that said heel bracket takes hold of the edge 26 of the sole of the boot during this movement and presses the heel of the boot forward as well as downward such that it exerts the required clamping and holding forces.

In order to prevent the entire holding forces from being exclusively absorbed by the levers 9 and 13 and the spring piston 17 in the closed position of the binding, a tread plate 24 that protrudes upward from the base plate 12 is provided on said base plate, with the drag bearing bolt 14 resting on the tread plate in the closed position.

With reference to the aforementioned second dead center position and the independence of the closing force from the force of the spring 21, it should be noted that a force component that would act on the heel bracket 7 and, in particular, its drag bearing 8, and that would extend perpendicularly upward from the snowboard surface would have the effect of the pivoting lever 9 pivoting upward in the counterclockwise direction with reference to the illustration according to FIG. 2. However, such a pivoting movement is not possible since the arm 15 is in the aforementioned second position in which the dead center position is exceeded and since a pivoting of the drag bearing 14 along a circular line, the center of which is the center of the drag bearing 10, would exert a tensile force that is directed backward in the direction toward the heel on the spring piston 17 via the drag bearing 16. Furthermore, this movement is not possible because the spring piston adjoins the sliding bearing 18 with the limit stop disk 20 that is rigidly connected to said spring piston. Consequently, the closing force of the binding does not depend on the stiffness of the spring 21.

In order to open the binding, the opening arm 22 is pivoted upward, namely away from the snowboard surface, with said opening arm pivoting around the drag bearing bolt 14 in the clockwise direction relative to FIG. 2. During this process, the arm 15 overcomes the aforementioned second dead center position and presses the spring piston 17 forward in the direction toward the toe 3 of the boot against the force of the spring 21. During the continued pivoting movement of the opening arm 22, the pivoting lever 9 is also moved, i.e., pivoted around the drag bearing 10 in the counterclockwise direction with reference to FIG. 2. Consequently, the heel bracket 7 is simultaneously moved upward, namely away from the snowboard surface, and toward the rear, namely away from the heel 6 of the boot 1. As soon as the first aforementioned dead center position is exceeded, all levers pivot into the open position according in FIG. 1 due to the force of the spring 21. After the first dead center position is reached during this opening movement, the spring piston is released again and it is no longer necessary to exert an external tensile force on the opening arm 22. The boot can be removed from the step-in position illustrated in FIG. 1 by additionally raising the heel and subsequently pulling the toe of the boot backward and out of the binding.

At this point it should also be mentioned that the two sliding bearings 18 and 19 must have a slight play for the spring piston 17 in order to be able to pivot the arm 15 from the second position in which the dead center position is exceeded, namely a position in which the angle between the center axis 28 of the spring piston 17 and the connecting line 27 between the two drag bearings 14 and 16 is less than 90°, into the second dead center position in which this angle is exactly 90°. During this small pivoting movement, the drag bearing bolt 14 is still stationary because the pivoting lever 9 is not yet moved. This causes the drag bearing 16 to move along an arc around the center of the drag bearing bolt 14 and not along a straight line. The two bearings 18 and 19 must have a slight play so as to be able to absorb the difference between the aforementioned arc and the straight line. This compensation could also be realized by fastening the spring piston 17 with the two sliding bearings 18 and 19 and the spring 21 on the base plate 12 in pivoting fashion, but this arrangement would be associated with higher expenditures for construction.

Figure 3:
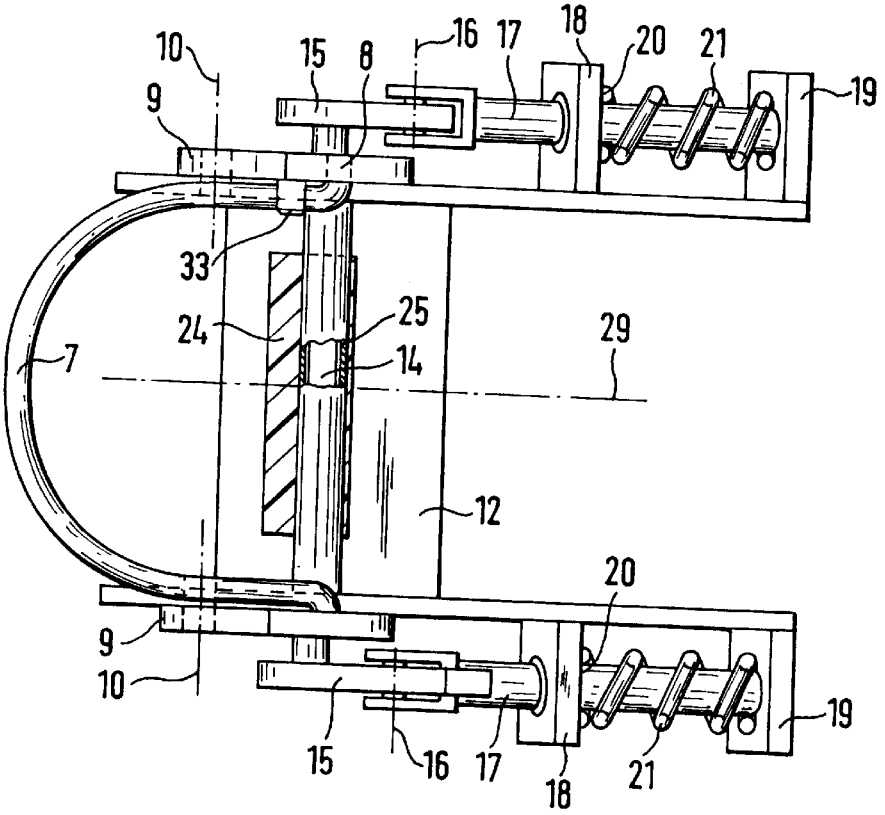
FIG. 3: a top view of the binding according to FIGS. 1 and 2 in the open position.

FIG. 3 shows a top view of the binding according to FIGS. 1 and 2 in the open position. This figure makes it clear that the binding has a mirror-symmetrical design relative to a central longitudinal axis 29 and, in particular, that the other components, e.g., the pivoting lever 9, the safety and opening lever 13, the spring piston 17 with the sliding bearings 18 and 19, the limit stop disk 20 and the spring 21, are respectively provided on both sides of the binding. This figure also makes it clear that the drag bearing bolt 14 extends transversely through the binding, is arranged on both pivoted levers 9 and connects both safety and opening levers 13 so that they rotate together.

FIG. 3 also shows that a sleeve 25 that is able to rotate relative to the drag bearing bolt 14 is pushed over said drag bearing bolt 14. This measure reduces the frictional forces because the sleeve 25 is able to roll along the sole of the boot and does not simply slide along said sole during the opening and closing movements. FIG. 3 also shows more clearly that the drag bearing bolt 14 or the sleeve 25 rests on the tread plate 24 while the binding is closed, i.e., the closing movement is limited. However, it should be emphasized at this point that a flawless, rigidly fixed closed position of the binding is already attained once the aforementioned second dead center position is exceeded, i.e., the binding also closes securely if snow or ice residues adhere to the binding or the boot as long as the second dead center position is exceeded.

At this point, it should be mentioned that the open position according to FIG. 1 is also clearly defined by the limit stop disk 20, and that the binding is held in the open position by the spring 21. This is also important for the ease of stepping into the binding. The heel bracket 6 can be additionally held in a predetermined pivoting position by means of a spring (not shown) that is already known from the state of the art. This pivoting position is chosen (compare to FIG. 1) such that the part of the heel bracket that overlaps the edge 26 of the boot still lies above the edge 26 in the open position if the sole already rests on the drag bearing bolt 14 within the heel region. A forward pivoting movement of the heel bracket 7 in the direction toward the toe of the boot can be limited by a limit stop 33 that is arranged on the pivoting lever 9 and protrudes into the pivoting path of the heel bracket.

It should also be mentioned that the spring 21 can be encapsulated, e.g., by means of a sleeve that connects the two sliding bearings 18 and 19.

In this figure, the spring piston 17 is illustrated in the form of a cylindrical piston. It can also have another cross-sectional shape, e.g., a rectangular, square, double-T, or U profile.

In this figure, the spring 21 is illustrated in the form of a helical spring. Naturally, it can also be replaced with other types of springs, e.g., disk springs or a sleeve consisting of elastic rubber which is pushed over the part of the spring piston 17 that is situated between the sliding bearings 18 and 19.

It should also be mentioned that the opening lever 22 is illustrated in the form of a draw lever in the embodiment examples according to FIGS. 1–3, i.e., it is pulled upward, namely away from the snowboard surface, in order to open the binding. Of course, it could also be realized in the form of a pressure lever, i.e., a lever that must be pressed downward against the snowboard surface in order to open the binding.

Figure 4:
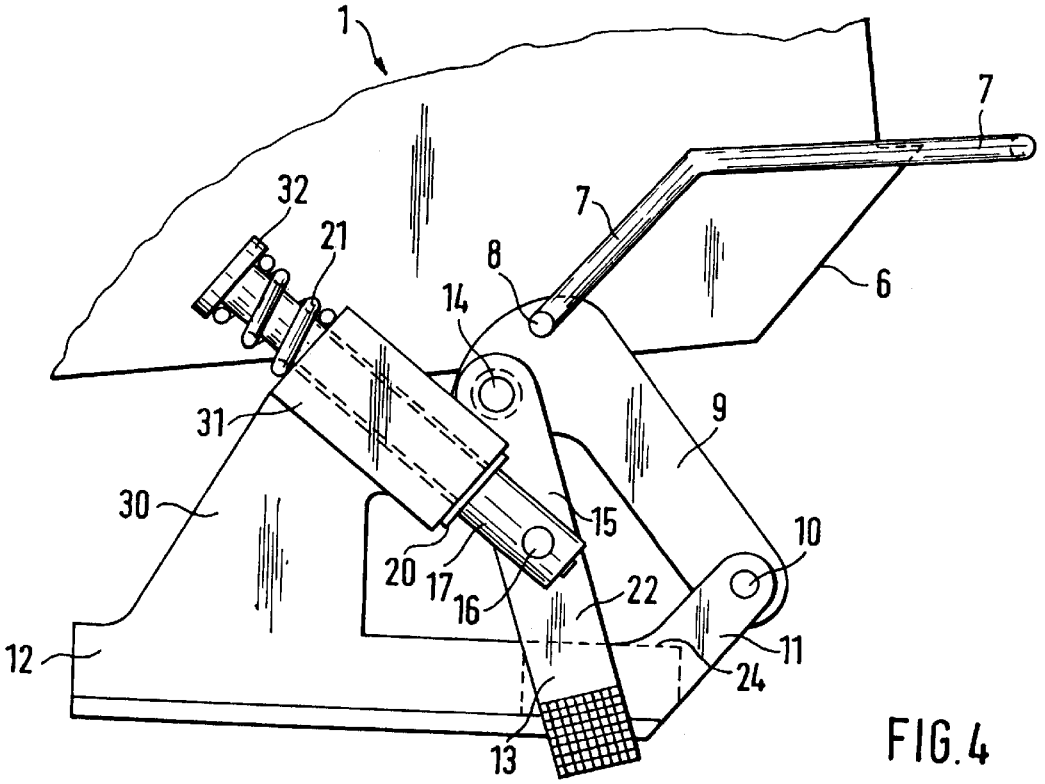
FIG. 4: a side view of a snowboard binding according to a second embodiment example of the invention in the open position.
Figure 5:
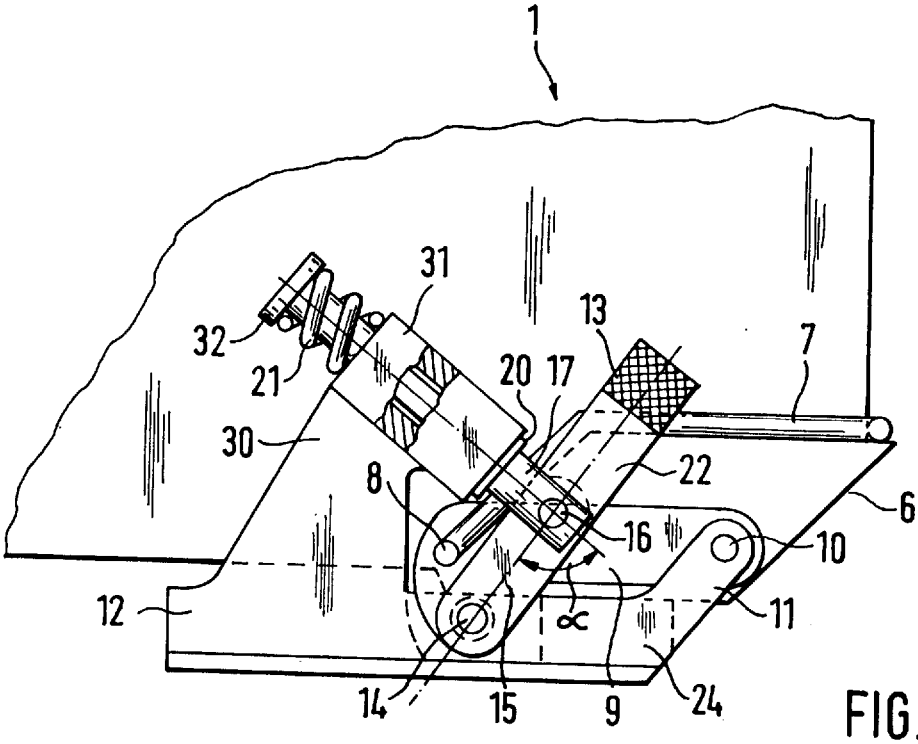
FIG. 5: a side view of the snowboard binding according to the second embodiment example in the closed position.
Figure 6:
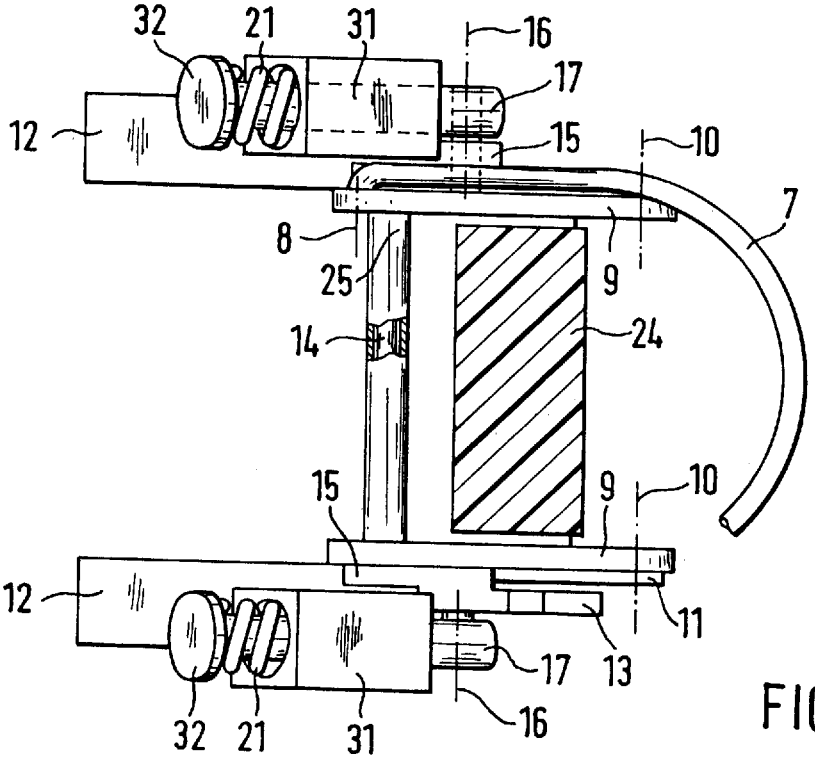
FIG. 6: a top view of the binding according to FIGS. 4 and 5 in the closed position.

The second embodiment example according to FIGS. 4–6 essentially differs from the first embodiment example in the arrangement of the spring piston and the safety and opening lever. The pivoting lever 9 is arranged in rotatable fashion on a support 11 via a drag bearing 10 as is the case with the first embodiment example, with the support 11 being rigidly connected to the base plate 12. The heel bracket 7 is fastened in pivoting fashion on the end of the pivoting lever 9 that is situated opposite to the drag bearing 10 via a drag bearing 8. In this case, the safety and opening lever 13 is also arranged in pivoting fashion on the pivoting lever 9 via a drag bearing bolt 14, with the axis of the drag bearing bolt 14 being arranged offset relative to the drag bearing 8. The safety and opening lever 13 is realized in linear fashion, with the drag bearing 16 being arranged approximately in its center such that the safety and opening lever 13 is divided into an arm 15 and the opening arm 22. The spring piston 17 is coupled to the drag bearing 16, with said spring piston being arranged differently from the embodiment examples according to FIGS. 1–3, i.e., such that it declines from the toe of the boot toward the heel, i.e., from the front toward the rear. However, this requires that the spring piston be arranged at a greater distance from the snowboard surface, which is why an upwardly protruding carrier 30 that holds the spring piston is arranged on the base plate 12.

Instead of being arranged in the two sliding bearings 18 and 19 according to FIGS. 1–3, the spring piston 17 in this embodiment example is arranged in a guide sleeve 31 such that it can be displaced axially. One end of the spring piston 17 which protrudes beyond this guide sleeve 31 is connected to the safety and opening lever 13 via the drag bearing 16, while the other end of the spring piston 17 which protrudes beyond the guide sleeve 31 carries the spring 21 that is supported between the guide sleeve 31 and a disk 32 that is rigidly arranged on one end of the spring piston 17. The end of the spring piston 17 which is connected to the lever 13 is rigidly connected to a limit stop disk 20 that is pressed against the guide sleeve 31 due to the force of the spring 21 and consequently limits the longitudinal displacement of the spring piston 17 toward the front, i.e., toward the toe of the boot. Otherwise, the limit stop disk has the same function as the limit stop disk 20 in the first embodiment example.

If the heel 6, originating from the open position according to FIG. 4, is pressed down in the direction toward the snowboard surface, the sole presses the drag bearing bolt 14 downward and pivots the pivoting lever around the drag bearing 10 in the counterclockwise direction with reference to FIG. 4. Consequently, the drag bearing bolt 14 travels along a circular path, the center point of which is the axis of the drag bearing 10. During this movement, the arm 15 exerts a tensile force that acts opposite to the force of the spring 21 on the spring piston 17 via the drag bearing 16 such that said spring piston is transversely displaced downward/backward and the limit stop ring 20 is released from the sleeve 31. During this pivoting movement, the three drag bearings 14, 16 and 10 will be situated along a straight line, i.e., the first dead center position is reached. If the boot is further pressed down, a first position in which the dead center position is exceeded is reached, namely a position in which the spring piston 17, due to the force of the spring 21, is moved into the opposite direction again, i.e., forward/upward, and the binding is also moved into the closed position by the spring 21. This closed position is reached once the limit stop disk 20 again comes in contact with the sleeve 31. In this case, the second dead center position is also reached, with said second dead center position being defined by the fact that the longitudinal axis of the spring piston 17 extends exactly perpendicular to the center axis of the arm 15 that connects the two drag bearings 14 and 16. Once this second dead center position is exceeded, a second position in which the dead center position is exceeded is reached, namely a position in which the binding remains closed independently of the force of the spring 21. Otherwise, the function is identical to that of the embodiment example described with reference to FIGS. 1–3.

In this case, the opening arm 22 is realized in the form of a pressure lever, i.e., the opening arm 22 must be pressed down in the direction toward the snowboard surface in order to open the binding—as described previously with reference to FIGS. 1–3.

In this embodiment example, the bearings 10, 14 and 16 also form a triangle, with the bearing 14 also lying above the two bearings 10 and 16 in the open position. During the closing movement, the pivoted arm 9 and the arm 15 of the closing lever 13 pivot—in contrast to the embodiment example according to FIGS. 1–3—in the same direction, with the bearing 14 traveling beyond the first dead center position outside of the connecting line between the bearings 10 and 16.

Figure 7:
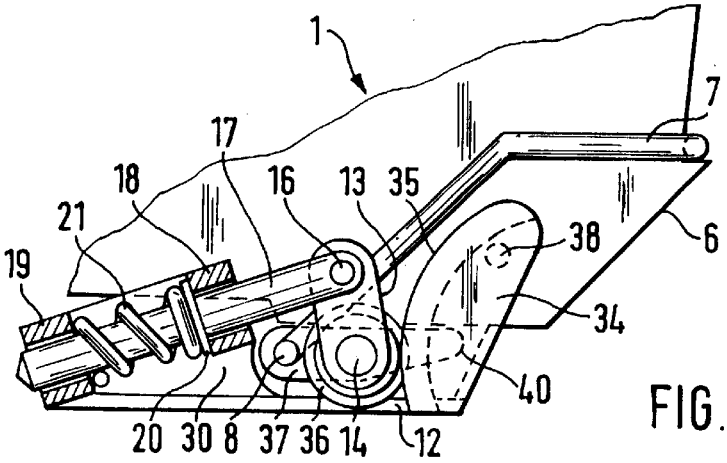
FIG. 7: a side view of a snowboard binding according to a third embodiment example of the invention in the closed position.
Figure 8:
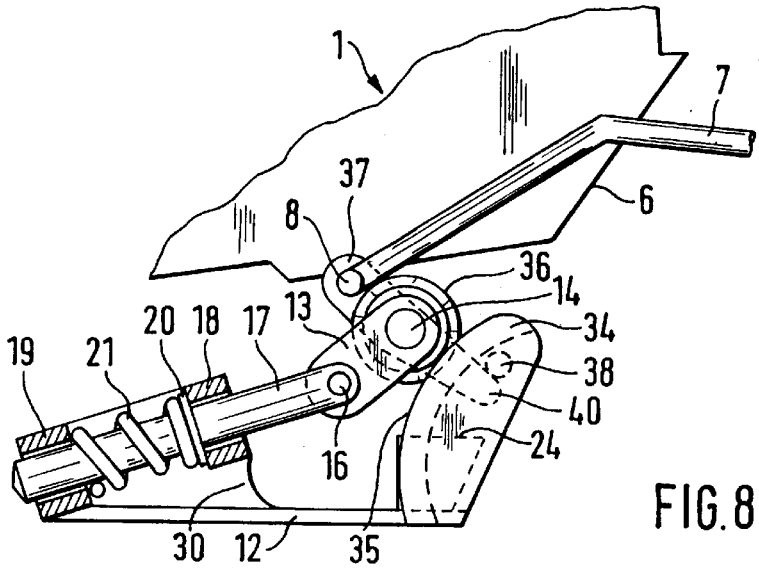
FIG. 8: a side view of the snowboard binding according to FIG. 7, but in the open position.
Figure 9:
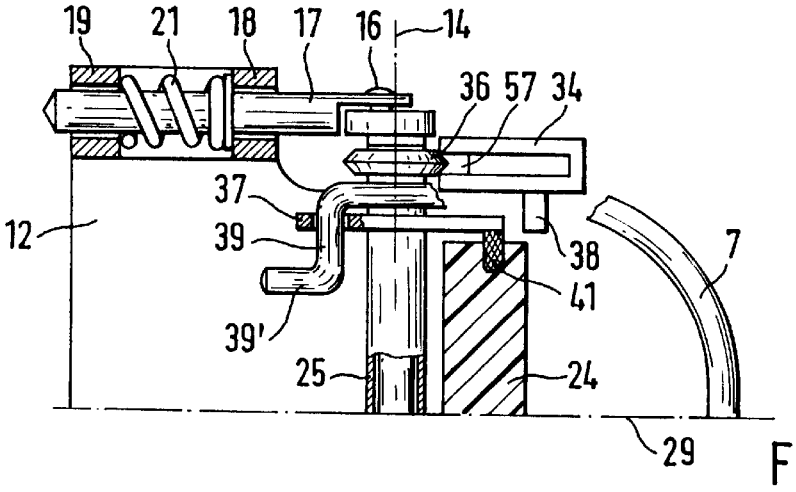
FIG. 9: a top view of the snowboard binding according to FIGS. 7 and 8 in the closed position.

The third embodiment example according to FIGS. 7–9 essentially differs from the first two embodiment examples in that the pivoting lever 9 is replaced by a crank guidance. A crank guidance 34 that protrudes upward from the snowboard surface is arranged on both sides of the base plate 12, with said crank guidance being provided with a guide surface 35 that points forward, namely toward the toe 3 of the boot. In the embodiment example shown, this guide surface is curved in the shape of an arc, with one tangent extending on this guide surface perpendicular to the surface of the snowboard, namely at the elevation of the upper side of the tread plate 24. However, the guide surface can also have a different shape, e.g., an ellipsoidal shape or a descending straight line, as long as it is insured that the heel bracket 7 is moved downward and forward in the direction toward the toe of the boot when closing the binding.

In this embodiment example, the drag bearing bolt 14 carries a rotatable roller 36 that rolls along the guide surface 35 of the crank guidance 34. However, the roller 36 can also be realized in the form of a gear, with the guide surface 35 of the crank guidance 44 in this case being provided with the corresponding teeth. In addition, the safety lever 13, the other end of which is connected to the spring piston 17 via the drag bearing 16, is fastened onto the drag bearing bolt 14. One additional lever 37 is fastened onto the drag bearing bolt 14 in pivoting fashion, with the drag bearing 8 for the pivoted fastening of the heel bracket being connected within the region of one end of this lever 37.

The lever 37 extends in the other direction beyond the drag bearing bolt 14 and overlaps the crank guidance 34. The crank guidance is provided with a locking bolt 38 within its upper end region that is situated opposite to the snowboard surface. This locking bolt serves as a limit stop for the aforementioned part of the lever 37 that protrudes beyond the drag bearing bolt 14 and defines the open position (FIG. 8) of the binding.

FIG. 9 makes it clear that the heel bracket 7 penetrates through the lever 37 with one respective section 39 such that the sole of the boot comes in contact with this location. The section 39 which serves as a tread element can also be bent forward at a right angle by means of one additional arm 39' such that the heel bracket 7 is pivoted upward around the drag bearing 8 formed by the section 39 when pressing down the boot. This measure insures that the rear end of the heel bracket 7 is sufficiently moved upward so as to overlap the edge 26. With further pressing down of the sole of the boot, the lever 37 is initially pivoted around the drag bearing bolt 14, with the other end 40 of the lever 37 adjoining the locking bolt 38 such that the roller 36 already rolls along the guide surface 35 during this upward movement. It is also possible to provide a sliding motion instead of a rolling motion, i.e., the roller 36 does not necessarily need to be arranged in rotatable fashion. With further pressing down of the boot, the sole of the boot also comes in contact with the drag bearing bolt 14.

The spring piston 17 with the sliding bearings 18 and 19, the limit stop disk 20 and the spring 21 are, in principle, realized and arranged identically to the first embodiment example illustrated in FIGS. 1–3.

If one presses the heel portion of the sole down on the drag bearing bolt 14 while the binding is in the open position (FIG. 8), the roller 36 rolls along the guide surface 35 of the crank guidance 34 and moves the drag bearing bolt 14 forward, i.e., in the direction toward the toe of the boot, and downward, i.e., in the direction toward the snowboard surface. During this process, the safety lever 13—originating from the position illustrated in FIG. 8—is pivoted around the drag bearing 16, namely in the clockwise direction with reference to FIG. 8. This causes the spring piston 17 to be simultaneously displaced forward/downward against the force of the spring 21. In this case, a toggle lever effect is attained due to a triangle that is formed by the drag bearing 16, the drag bearing bolt 14 and the contact point between the roller 36 and the guide surface 35. This toggle lever effect causes the relatively minute pressing forces of the heel to suffice for overcoming the force of the spring 21. The limit stop between the lever 37 and the locking bolt 38 also insures the heel bracket 7 to be situated sufficiently far toward the rear in the open position.

With further pressing down of the drag bearing bolt 14, a first dead center position is reached, with said first dead center position being defined by the fact that the drag bearing 16, the drag bearing bolt 14 and the contact point between the roller 36 and the guide surface 35 lie on a straight line. In this first dead center position, the spring piston 17 is pressed forward/downward as far as possible, i.e., against the force of the spring 21. When pressed down further, this first dead center position is exceeded once the center axis of the drag bearing bolt 14 lies underneath the connecting line between the drag bearing 16 and the contact point between the roller 36 and the guide surface 35. Beginning at this time, the spring piston 17, with further pressing down of the boot, is pressed backward/upward again due to the force of the spring 27, with the safety lever 13 continuing to pivot in the clockwise direction, with reference to the illustrations in FIGS. 7 and 8.

After exceeding the first dead center position, the spring 21 presses the spring piston backward/upward again, with the roller gliding downward/forward again along the guide surface. The second dead center position is reached as soon as a right angle is formed by the center axis of the spring piston 17 and the connecting line between the drag bearing 16 and the drag bearing bolt 14. In this case, the roller 36 is already in its lowest position, but the spring piston 17 is not yet extended up to the limit stop 20. However, the spring piston 17 is subsequently fully extended up to the limit stop 20 due to the force of the spring 21 such that the locking arm 13 is additionally pivoted around the drag bearing 16 (namely in the clockwise direction with reference to FIG. 7) and the second dead center position is exceeded, i.e., the binding reaches the second position in which the dead center position is exceeded, namely a position in which the aforementioned angle is smaller than 90°. The locked position is reached once the limit stop disk 20 contacts the limit stop 18.

Since the section 39 of the heel bracket 7 as well as the drag bearing bolt 14 adjoin the sole of the boot in the closed position, the lever 37 is aligned parallel to the sole of the boot and held by said sole. It is also possible to provide the free end 40 of the lever 37 with one respective inwardly protruding projection 41 that also adjoins the sole of the boot such that the position of the lever 37 or its alignment relative to the sole of the boot is clearly defined in the closed position. In this binding, the closed position is also defined by the second position in which the dead center position is exceeded and consequently not dependent on the force of the spring 21.

In order to open the binding, the closing lever 13 is pivoted—namely in the same fashion as in the first embodiment example. For this purpose, an opening lever (not shown) that corresponds to the opening arm 22 of the first two embodiment examples is connected to the closing lever 13.

Figure 10:
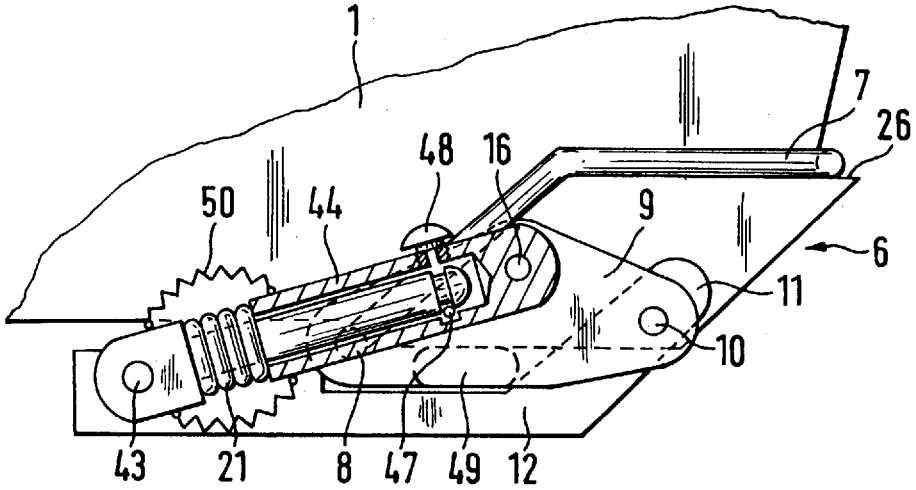
FIG. 10: a side view of a snowboard binding according to a fourth embodiment example of the invention in the closed position.
Figure 11:
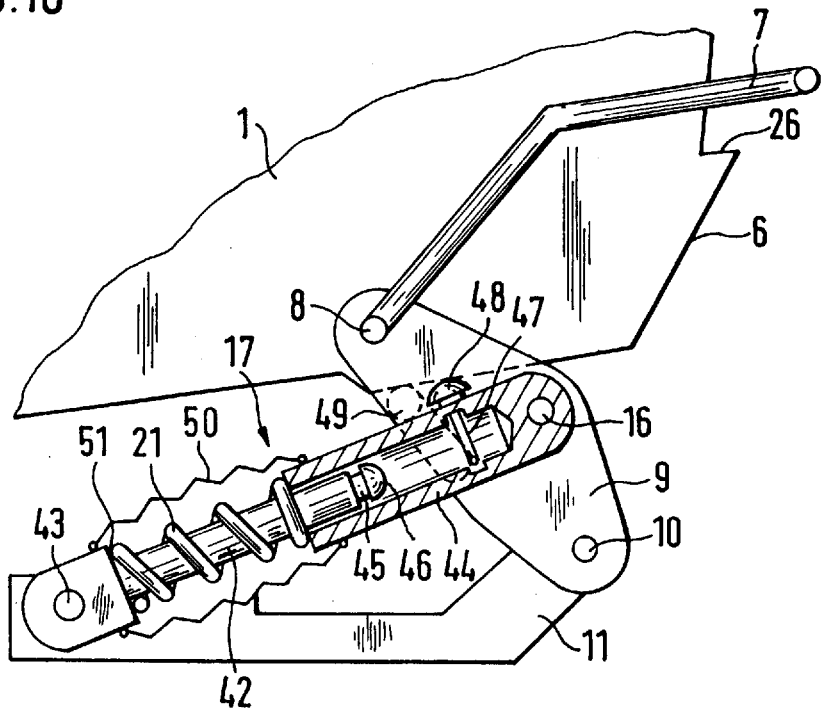
FIG. 11: a side view of the binding according to FIG. 10 in the open position.

FIGS. 10 and 11 show a fourth embodiment example of the invention which essentially differs from the first three embodiment examples in that a different closing or safety mechanism is provided.

In this embodiment example, a pivoting lever 9 is fastened onto a support 11 that is fastened onto the ground plate 12 via a drag bearing 10. The other end of the pivoting lever 9 holds the heel bracket 7 via the drag bearing 8. In contrast to the embodiment examples described thus far, the drag bearing 16 for realizing the coupling with the spring piston 17 is in this embodiment example also arranged on the pivoting lever 9, i.e., approximately in its center between the two drag bearings 8 and 10, but offset relative to a connecting line between said drag bearings 8 and 10. The spring piston 17 in this embodiment example is designed differently and consists of a piston rod 42 that is fastened to the ground plate 12 by means of a drag bearing 43. The spring 21 that is supported between a limit stop 51 within the region of the drag bearing 43 and a sleeve 44 is pushed over this piston rod 42. The sleeve 44 can be displaced along the piston rod 42 and encloses said piston rod. In addition, the sleeve 44 is coupled to the pivoting lever 9 via the drag bearing 16.

The sleeve 44 is provided with a locking spring 47 that can be displaced via an actuating button 48. This locking spring 47 catches in the groove 45 if the binding is locked (FIG. 10) and consequently fixes the sleeve 44 on the piston rod 42 such that the position assumed by the pivoting lever 9 is also defined. In contrast to the embodiment examples described thus far, a tread element 49 that connects the two pivoted levers 9 to one another is arranged on the pivoted levers 9 that are situated to the right and the left of the sole of the boot.

In this embodiment example, the spring 42 is surrounded by an expansion bellows 50 that seals this spring toward the outside and is fastened onto the sleeve 44 and the piston rod 42 within the region of the drag bearing 43.

It is also possible to provide a different locking mechanism than the spring 47 and the groove 45, e.g., by providing the piston rod 42 with toothing instead of a groove 45 and providing the sleeve 44 with a detent pawl that is prestressed by a spring and presses the spring into a position in which it engages with the toothing. This measure insures a flawless locking of the binding, namely even if more snow or ice is situated underneath the sole of the boot. The binding can be opened by pivoting the detent pawl into the open position.

In the open position according to FIG. 11, the spring 21 is released and presses the sleeve 44 and consequently the pivoting lever 9 into the open position. The closing of the binding is realized by pressing the tread element 49 down with the sole of the boot within the region of the heel such that the pivoting lever 9 is pivoted around the pivoting axis 10 (namely in the counterclockwise direction with reference to FIG. 11). During this movement, the sleeve 44 is pressed forward/downward against the force of the spring 21 such that the entire spring piston 17 is pivoted around the bearing 43. As soon as the groove 45 of the piston rod 42 reaches the locking spring 47 during this pivoting movement, said locking spring catches in the groove 45 such that the binding is locked. In this position (compare to FIG. 10), the spring 21 is greatly compressed. The locking of the binding is realized by a positive connection between the groove 45 and the locking spring 47.

In order to open the binding, the actuating button 48 is depressed such that the locking spring 47 is released from the groove 45 and the binding can be opened by moving the heel of the boot upward, namely away from the snowboard surface.

Figure 12:
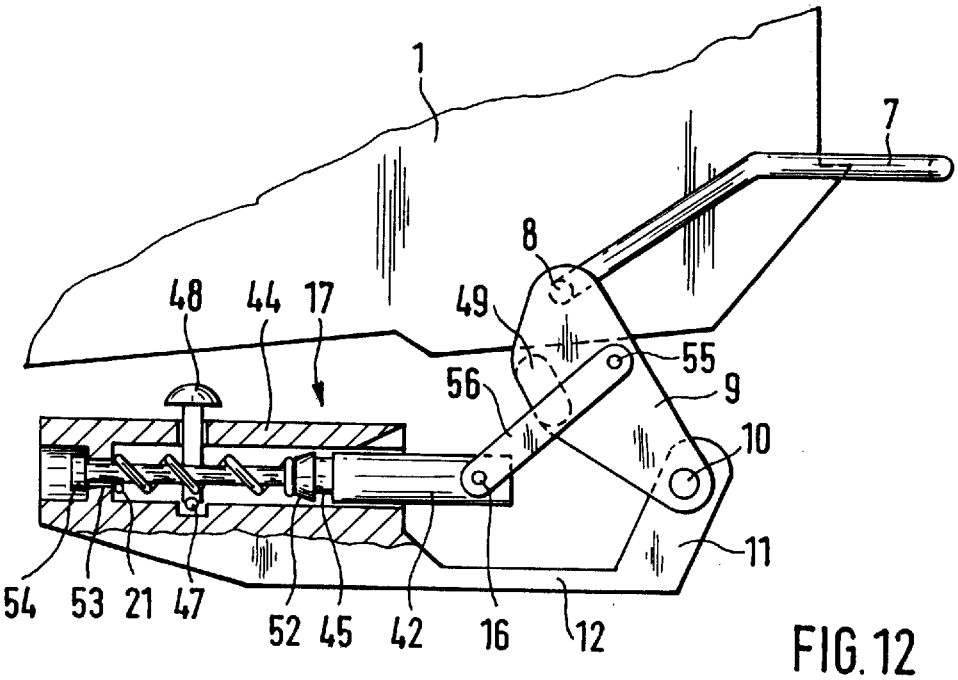
FIG. 12: a side view of a snowboard binding according to a fifth embodiment example of the invention in the open position.
Figure 13:
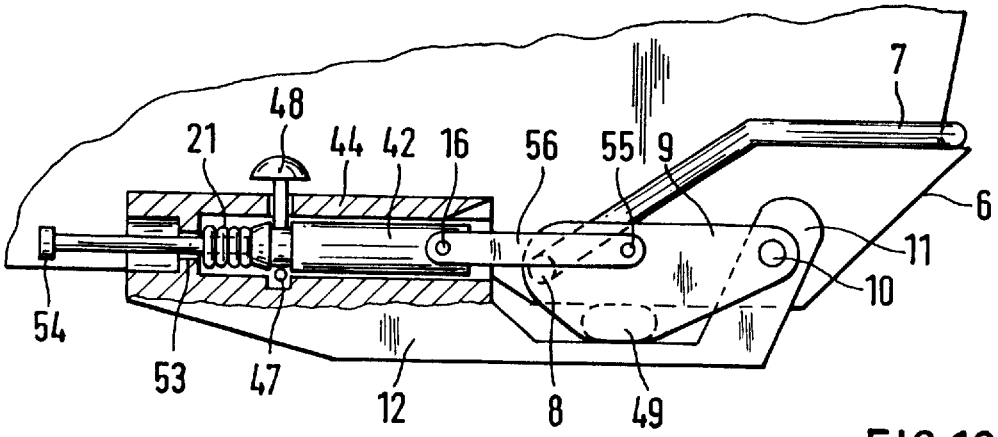
FIG. 13: a side view of the snowboard binding according to FIG. 12 in the closed position.

FIGS. 12 and 13 show a fifth embodiment example of the invention, which, with respect to the locking mechanism, is realized similarly to the fourth embodiment example shown in FIGS. 10 and 11. However, the lever mechanism is realized similarly to the first three embodiment examples.

In this embodiment example, the heel bracket is fastened onto the pivoting lever 9 via a drag bearing 8, with said pivoting lever being fastened onto a support 11 via a drag bearing 10. The support is preferably integrally connected to the base plate 12. The two pivoted levers 9 of the binding are connected to one another via the tread element 49. However, the pivoting lever 9 in this embodiment example is not directly connected to the spring piston 17, but via one additional lever 56 that has functional similarities to the closing lever 15 according to FIG. 1. The aforementioned pivoting lever is, in particular, connected to the movable piston rod 42, namely via the drag bearing 16 and a drag bearing 55 on the pivoting lever 9 which functionally corresponds to the drag bearing formed by the drag bearing bolt 14 in FIG. 1.

The piston rod 42 is arranged in the sleeve 44 such that it can be displaced in the longitudinal direction, with the sleeve 44 of this embodiment example being arranged on the base plate 12 in rigid fashion, i.e., in such a way that it cannot be pivoted. A section of the piston rod 42 that is situated in the interior of the sleeve 44 is surrounded by the spring 21 that is supported between a limit stop 53 of the sleeve 44 and a collar 52 of the piston rod 42, with said collar 52 having a conical shape and transforming into the groove 45 at its end that is situated opposite to the spring 21. As in the case of the embodiment example according to FIGS. 10 and 11, a locking spring 47 is arranged in the sleeve 44, with said locking spring being moved into a release position by means of the actuating button 48. The end of the piston rod 42, which is situated in the interior of the sleeve 44, has an enlargement that serves as a limit stop 54, is pressed against the limit stop 53 by the spring 21 and consequently defines the open position (FIG. 12). In this case, the section of the pivoting lever 9 that is situated between the bearings 10 and 55 and the lever 56 between the bearings 16 and 55 form a toggle lever. This toggle joint causes the piston rod 42 to be pushed further into the sleeve 44 against the force of the spring 21 if the tread element 49 is pressed down and the lever 9 is pivoted. During this process, the conical collar 52 slides past the locking spring and spreads apart said locking spring until it catches in the groove 45 and consequently locks the binding (compare to FIG. 13) during the additional forward movement of the piston rod 42 (in the direction toward the toe of the boot).

This binding is opened in the same fashion as in the embodiment example according to FIGS. 10 and 11, namely by pressing the actuating button 48 such that the locking spring 47 is released from the groove 45. Subsequently, the piston rod 42 is pressed backward by the force of the spring. However, the binding is not yet able to open because the three bearings 16, 55 and 10 lie on a straight line in the open position according to FIG. 13, i.e., in one dead center position of the aforementioned toggle lever. Consequently, the heel of the boot must be slightly raised, whereafter the pivoting lever 9 and the bearing 10 are pivoted upward via the heel bracket 7 and the bearing 8. The spring 21 only promotes the additional opening movement once the bearing 55 lies slightly above the connecting line between the bearings 16 and 10. The previous description makes it clear that only very minute forces act upon the locking spring 47 in the closed position as long as the three bearings 16, 55 and 10 are situated in a dead center position.

According to an additional alternative embodiment of the invention, the bearing 55 can also be fastened onto the pivoting lever in such a way that it lies underneath a connecting line between the bearings 16 and 10 in the closed position, i.e., in a position in which the dead center position is exceeded. This only requires the groove 45 to be slightly widened such that the locking spring 47 does not prevent the position at which the dead center position is exceeded from being reached.

In conclusion, it should also be mentioned that the spring piston 17 can assume many different positions. For example, as shown in FIG. 1, it can lie transverse to the snowboard surface and incline toward the heel. It can also be arranged such that it declines toward the heel—as shown in FIG. 5. It can even lie parallel to the snowboard surface and be arranged in such a way that it is situated underneath the sole of the boot.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A snowboard binding adapted for releasably binding a boot to a snowboard, the binding being capable of movement between a closed position in which the boot is secured in the binding and an open position in which the boot can be released from the binding, comprising:

a front bracket for partially overlapping a sole of the boot at its toe and a heel bracket for partially overlapping the sole of the boot at its heel, one of said brackets being fastened on two sides to a pivoting lever that can be moved relative to a binding component affixed to the snowboard;

a first drag bearing, by means of which the pivoting lever is fastened onto the binding component;

a second drag bearing that connects the pivoting lever to a closing lever; and a third drag bearing that connects the closing lever to a spring piston so that said closing lever pivotably connects said pivoting lever to one end of the spring piston, the spring piston being capable of exerting a spring force along its longitudinal axis;

wherein in the open position, said first, second and third drag bearings are arranged such that they define a first triangle, with the second drag bearing lying above the first and the third drag bearings;

wherein during the course of movement from the open position to the closed position said drag bearings lie on a straight line that defines a dead center position; and wherein in the closed position of the binding, the three drag bearings define a second triangle, with the second drag bearing lying below a connecting line between the first and the third drag bearings; and a limit stop for limiting movement of the spring piston.

2. The snowboard binding adapted for releasably binding a boot to a snowboard according to claim 1 wherein the spring piston is aligned parallel to the snowboard.

3. The snowboard binding for releasably binding a boot to a snowboard according to claim 1 wherein the spring piston is aligned transverse to the snowboard.

4. A snowboard binding adapted for releasably binding a boot to a snowboard, the binding being capable of movement between a closed position in which the boot is secured in the binding and an open position in which the boot can be released from the binding, comprising:

a front bracket for partially overlapping a sole of the boot at its toe and a heel bracket for partially overlapping the sole of the boot at its heel, one of said brackets being fastened on two sides to a pivoting lever that can be moved relative to a binding component affixed to the snowboard;

a first drag bearing, by means of which the pivoting lever is fastened onto the binding component, a second drag bearing that connects the pivoting lever to a closing lever;

a third drag bearing that connects the closing lever to a spring piston so that said closing lever pivotably connects said pivoting lever to one end of the spring piston, the spring piston being capable of exerting a spring force along its longitudinal axis; and a limit stop for limiting movement of the spring piston when the binding is in the open position as well as in the closed position;

wherein in the open position, said first, second and third drag bearings are arranged such that they define a first triangle, with the second drag bearing lying above the first and the third drag bearings;

wherein during the course of movement from the open position to the closed position said drag bearings lie on a straight line that defines a dead center position;

wherein in the closed position of the binding, the three drag bearings define a second triangle, with the second drag bearing lying below a connecting line between the first and the third drag bearings;

wherein the longitudinal axis of the spring piston and a central axis extending through said second and third bearings define an angle, the angle being less than 90° in the closed position and greater than 90° in the open position; and wherein the pivoting lever and the spring piston are arranged such that, when the binding is in the closed position, an opening movement originating from the pivoting lever acts upon the spring piston via the closing lever in a direction of movement that is limited by said limit stop.

5. The snowboard binding according to claim 4 wherein the closing lever is arranged so as to rotate in a direction opposite to the pivoting movement direction of the pivoting lever.

6. The snowboard binding according to claim 5 wherein the limit stop limits movement of the spring piston in the direction of the spring force, and the driving element, closing lever and spring piston are arranged such that, when the binding is in its closed position, an opening movement originating from the driving element acts upon the spring piston via the closing lever in a direction of movement that is limited by said limit stop.

7. The snowboard binding according to claim 5 wherein the spring piston comprises a piston rod and a sleeve which can be displaced relative to one another, with the spring being arranged in such a way that the piston rod and the sleeve are pressed apart by the spring.

8. The snowboard binding according to claim 4 wherein the closing lever is arranged so as to rotate in the same direction as the pivoting movement direction of the closing lever.

9. The snowboard binding adapted for releasably binding a boot to a snowboard according to claim 4 wherein one respective pivoting lever is arranged on opposite sides of the heel of the boot, and both pivoting levers are connected to one another via a tread element that extends transverse to the longitudinal axis of the boot.

10. The snowboard binding according to claim 4 further comprising an opening arm comprising a tensioning or pressure lever fastened onto the closing lever.

11. The snowboard binding according to claim 4 further comprising a tread plate which serves as a limit stop for pressing down the sole of the boot.

12. The snowboard binding according to claim 11 wherein the tread element is disposed within a sleeve which is rotatable relative to the tread element.

* * * * *